US011732441B2

(12) United States Patent
Nishikawa et al.

(10) Patent No.: US 11,732,441 B2
(45) Date of Patent: Aug. 22, 2023

(54) CONSTRUCTION MACHINE

(71) Applicant: HITACHI CONSTRUCTION MACHINERY CO., LTD., Tokyo (JP)

(72) Inventors: Shinji Nishikawa, Kasumigaura (JP); Ryousuke Itou, Tsuchiura (JP); Katsuaki Kodaka, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 340 days.

(21) Appl. No.: 17/272,694

(22) PCT Filed: Jan. 15, 2020

(86) PCT No.: PCT/JP2020/001116
§ 371 (c)(1),
(2) Date: Mar. 2, 2021

(87) PCT Pub. No.: WO2020/195031
PCT Pub. Date: Oct. 1, 2020

(65) Prior Publication Data

US 2021/0348362 A1 Nov. 11, 2021

(30) Foreign Application Priority Data

Mar. 26, 2019 (JP) ..... 2019-059451

(51) Int. Cl.
*E02F 9/20* (2006.01)
*E02F 9/24* (2006.01)
(Continued)

(52) U.S. Cl.
CPC ..... *E02F 9/2066* (2013.01); *E02F 9/24* (2013.01); *E02F 9/26* (2013.01); *F02N 19/00* (2013.01); *F02P 19/026* (2013.01)

(58) Field of Classification Search
CPC ... E02F 9/2066; E02F 9/24; E02F 9/26; E02F 9/261; F02D 2041/228; F02D 2200/023;
(Continued)

(56) References Cited

U.S. PATENT DOCUMENTS 5,990,800 A * 11/1999 Tamaki ..... F02N 11/0807 307/10.6
8,335,618 B2 * 12/2012 Knapp ..... F02N 11/0803 701/84
(Continued)

FOREIGN PATENT DOCUMENTS

JP 2006-274750 A 10/2006
JP 2009-138497 A 6/2009
(Continued)

OTHER PUBLICATIONS

International Preliminary Report on Patentability received in corresponding International Application No. PCT/JP2020/001116 dated Oct. 7, 2021.
(Continued)

*Primary Examiner* — Tyler J Lee
(74) *Attorney, Agent, or Firm* — Mattingly & Malur, PC

(57) ABSTRACT

There is provided a construction machine that draws attention from the surroundings of the machine body when the prime mover is started and that can have the operator reliably confirm the surroundings of the machine body before the prime mover is started. An engine start control section 23 of a main controller 22 inhibits an engine 18 from
(Continued)

starting when a key switch 12 is operated while a horn switch 21 is not operated, inhibits the engine 18 from starting when the key switch 12 is operated for the duration until a first set time T1 elapses after the operation of the horn switch 21 has been finished, permits the engine 18 to start in a case the key switch 12 is operated for the duration until a second set time T2 elapses after the first set time T1 has elapsed, and inhibits the engine 18 again from starting when the key switch 12 is operated if the engine 18 is not started for the duration until the second set time T2 elapses.

4 Claims, 7 Drawing Sheets

(51) Int. Cl.
*E02F 9/26* (2006.01)
*F02N 19/00* (2010.01)
*F02P 19/02* (2006.01)

(58) Field of Classification Search
CPC .. F02D 2200/70; F02D 29/04; F02N 11/0803; F02N 11/101; F02N 19/00; F02N 2200/023; F02N 2200/12; F02P 19/02; F02P 19/026
See application file for complete search history.

(56) References Cited

U.S. PATENT DOCUMENTS

2010/0131150 A1* 5/2010 Knapp ..... F02N 11/0803 701/29.2
2010/0277590 A1 11/2010 Ariga et al.
2013/0312616 A1* 11/2013 Shibamori ..... F01N 3/023 96/419
2015/0183435 A1* 7/2015 Johnson ..... F02D 17/04 701/112

FOREIGN PATENT DOCUMENTS

JP 5637554 B 12/2014
JP 2019-27048 A 2/2019

OTHER PUBLICATIONS

Korean Office Action received in corresponding Korean Application No. 10-2021-7005260 dated Jul. 20, 2022.
International Search Report of PCT/JP2020/001116 dated Mar. 17, 2020.

* cited by examiner

CONSTRUCTION MACHINE

TECHNICAL FIELD

The present invention relates to a construction machine including a warning generating device for drawing attention from the surroundings of the machine body when the prime mover such as an engine or like is started.

BACKGROUND ART

Generally, instruction manuals for hydraulic excavators that are a typical example of construction machines contain a statement that when the engine is to start, the operator should confirm that no one is present in the surroundings and start the engine after honking the horn as a warning generating device.

Patent Document 1 discloses a construction machine that inhibits the engine from starting when there is no warning from warning generating means (horn), permits the engine to start when a warning is generated and when the warning is continuously generated for a first set time, and limits the permission to start the engine only to the duration of a second set time after elapse of the first set time.

Prior Art Document

Patent Document

Patent Document 1: Japanese Patent No. 5637554

SUMMARY OF THE INVENTION

Problems to be Solved by the Invention

With the construction machine disclosed in Patent Document 1, since the engine is permitted to start during the second set time only when a warning is generated by the warning generating means (horn), it is considered that it is possible to let workers in the surroundings of the machine body know an engine start before the engine starts.

According to Patent Document 1, however, the engine can be started immediately after a warning has been generated for the first set time or longer on the premise that the operator should preferentially be prevented from having an uneasy feeling and the engine should be started immediately after the horn has been honked. Therefore, some operators may possibly start the engine before sufficiently confirming the surroundings of the machine body.

The task of having the operator confirm the surroundings of the machine body before the prime mover starts exists as well in relation to electric hydraulic excavators that incorporate an electric motor as the prime mover rather than an engine.

The present invention has been made to solve the problems. It is an object of the present invention to provide a construction machine that draws attention from the surroundings of the machine body when the prime mover is started and that can have the operator reliably confirm the surroundings of the machine body before the prime mover is started.

Means for Solving the Problems

In order to solve the problems, there is provided a construction machine including a prime mover, a hydraulic drive system including a hydraulic pump driven by the prime mover, a prime mover starting device including a start operation device for starting the prime mover, a warning generating device, a warning operation device for actuating the warning generating device, and a controller. The controller is configured to inhibit the prime mover from starting when the start operation device is operated while the warning operation device is not being operated, inhibit the prime mover from starting when the start operation device is operated even for the duration until a first set time elapses after the warning operation device finishes being operated, permit the prime mover to start in a case the start operation device is operated for the duration until a second set time elapses after the first set time has elapsed, and inhibit the prime mover from starting when the prime mover has not been started for the duration until the second set time elapses.

By thus inhibiting the prime mover from starting when the start operation device is operated while the warning operation device is not operated, since the operator has to actuate the warning generating device in order to start the prime mover, a start of the engine can reliably be known to the surroundings of the machine body when the prime mover is to start, and thus drawing attention from the surroundings of the machine body is possible. Furthermore, even for the duration until the first set time elapses after the operation of the warning operation device has been finished, the prime mover is inhibited from starting when the start operation device is operated, and for the duration until the second set time elapses after the first set time has elapsed, the prime mover is permitted to start in a case the start operation device is operated, thereby having the operator reliably confirm the surroundings of the machine body before the prime mover is started.

Advantages of the Invention

According to the present invention, attention is drawn from the surroundings of the machine body when the prime mover is started and the operator can reliably confirm the surroundings of the machine body before the prime mover is started.

MODES FOR CARRYING OUT THE INVENTION

Embodiments of the present invention will hereinafter be descried below with reference to the drawings.

~Structure~

(Hydraulic Excavator)

Figure 1:
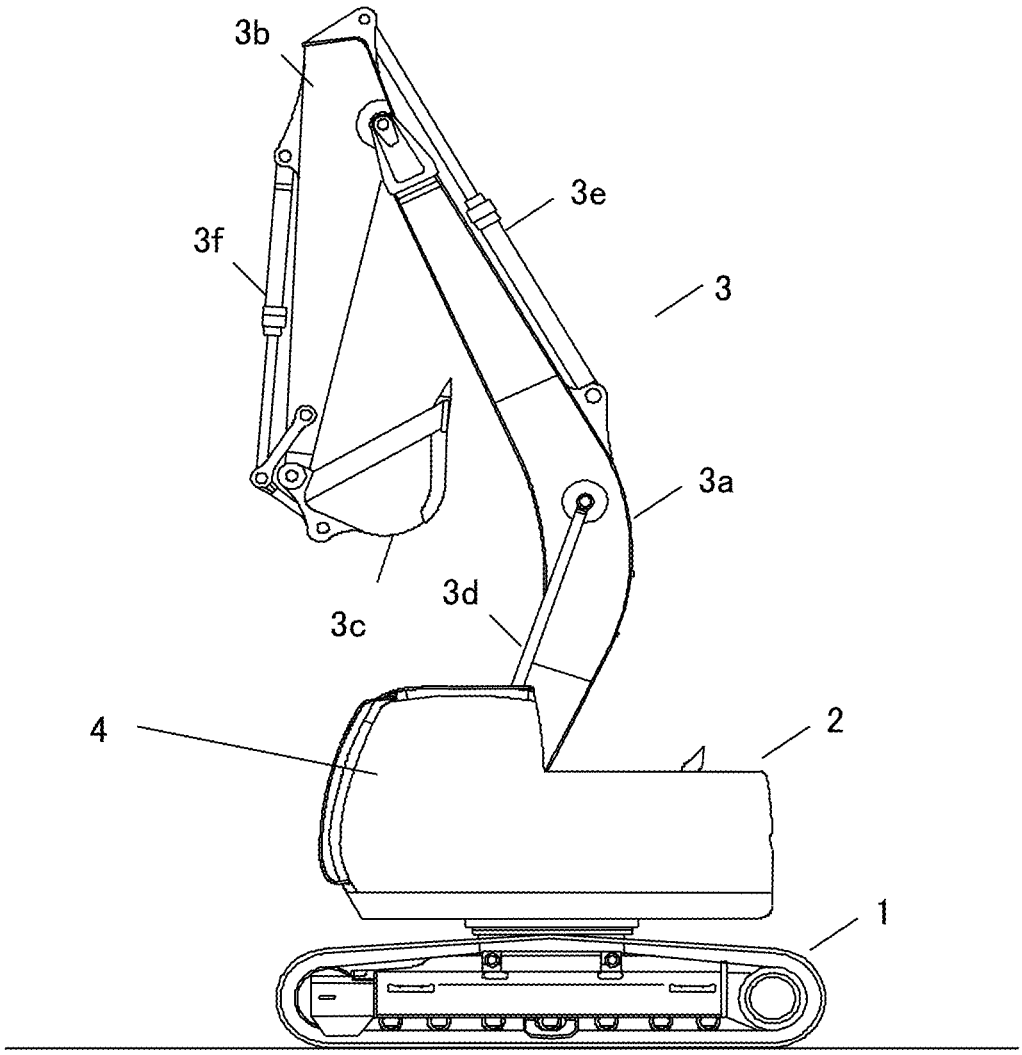
FIG. 1 is a view illustrating the appearance of a hydraulic excavator as an example of a construction machine according to an embodiment of the present invention.

FIG. 1 is a view illustrating the appearance of a hydraulic excavator as an example of a construction machine according to an embodiment of the present invention.

In FIG. 1, the hydraulic excavator (construction machine) includes a crawler-type lower track structure 1, an upper swing structure 2 swingably mounted on the lower track structure 1, and a front work implement 3 vertically movably mounted on a front portion of the upper swing structure 2.

The lower track structure 1 is provided with a pair of left and right travelling hydraulic motors (not shown) therein, and has left and right crawlers independently rotatably driven by the travelling hydraulic motors and speed reducer mechanisms and the like of the travelling hydraulic motors for travelling the hydraulic excavator forwardly or rearwardly.

The upper swing structure 2 includes a control lever device for performing various operations of the hydraulic excavator, a cabin 4 housing a seat where the operator can be seated, and the like, a prime mover such as an engine or the like, and hydraulic devices including a hydraulic pump driven by the engine, a swing motor (not shown) actuated by a hydraulic fluid delivered under pressure from the hydraulic pump, and so on. The upper swing structure 2 is swung rightwardly or leftwardly with respect to the lower track structure 1 by the swing motor. The cabin 4 also houses a monitor 26 (display device, see FIG. 2) for display various instruments and machine body information for the operator to see to confirm the state of the hydraulic excavator (construction machine).

The front work implement 3 includes a boom 3*a*, an arm 3*b*, and a bucket 3*c*. The boom 3*a* is vertically moved by a boom cylinder 3*d*, and the arm 3*b* is operated by an arm cylinder 3*e* to perform a dumping operation (opening operation) or a crowding operation (scooping operation). The bucket 3*c* is operated by a bucket cylinder 3*f* to perform a dumping operation or a crowding operation. As with the swing motor, the boom cylinder 3*d*, the arm cylinder 3*e*, and the bucket cylinder 3*f* are also actuated by a hydraulic fluid delivered under pressure from the hydraulic pump referred to above. The hydraulic pump, the swing motor, the boom cylinder 3*d*, the arm cylinder 3*e*, the bucket cylinder 3*f*, and directional control valves, not shown, jointly make up a hydraulic drive system including the hydraulic pump.

(Control System)

Figure 2:
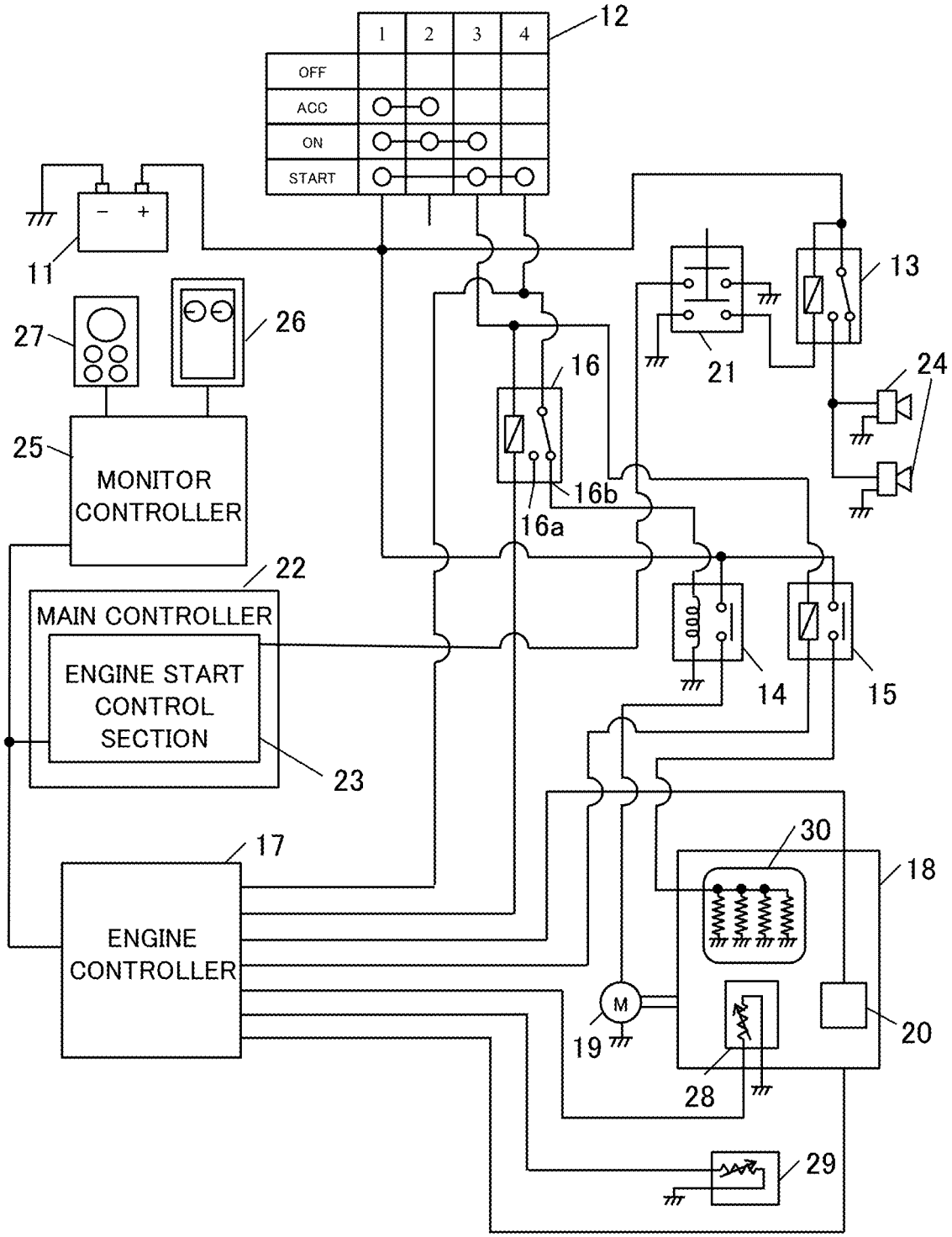
FIG. 2 is a diagram illustrating a circuit configuration of a control system including an engine starting device according to the embodiment of the present invention.

FIG. 2 is a diagram illustrating the circuit configuration of a control system including an engine starting device according to the embodiment of the present invention.

In FIG. 2, the hydraulic excavator according to the present embodiment includes a battery 11 (power supply) in the form of a 24V lead storage battery as a power supply for actuating various electric components. The battery 11 is electrically connected to a key switch 12 (start operation device), a horn relay 13, a starter relay 14, and a glow relay 15.

The key switch 12 is in the form of a rotary key cylinder and can selectively be turn into an OFF position, an ACC position, an ON position, and a START position when the operator inserts a key into the key switch 12 and turns the key. FIG. 2 illustrates terminal connections that can be made in the key switch 12 when the key switch 12 is in the positions described above. For example, when the key switch 12 is turned into the ON position, terminals 1, 2, and 3 are connected to each other, and a terminal 4 is not connected to the other terminals. The key switch 12 is of such a structure that after the key switch 12 has been turned into any of the positions other than the START position, the key switch 12 remains in those positions when the operator takes its hand off the key, and after the key switch 12 has been turned into the START position, the key switch 12 automatically returns to the ON position when the operator takes its hand off the key.

When the key switch 12 is turned into the ON position, the battery 11 is electrically connected to a starter cutting relay 16 through the key switch 12, and is also electrically connected to an engine controller (ECU) 17 through the coil of the starter cutting relay 16.

The engine controller 17 is also electrically connected to an engine 18. The engine controller 17 receives various sensor signals from the engine 18 and monitors the state of the engine 18, and simultaneously actuates a fuel injection device of the engine 18 to control the rotational speed and torque of the engine 18.

When the key switch 12 is turned into the START position in order to start the engine 18, it applies a 24V signal from the battery 11 to the engine controller 17, which detects an engine start operation. The starter cutting relay 16 that can selectively be turned on and off by the engine controller 17 is electrically connected to the engine controller 17. When the starter cutting relay 16 is turned off (de-energized), an electric current flows through a terminal 16*b* of the starter cutting relay 16 to the coil of the starter relay 14, turning on the starter relay 14 that allows an electric current to flow to a starter motor 19. As a result, the starter motor 19 is connected to the engine 18 and is simultaneously rotated to start the engine 18.

The rotational speed of the engine 18 is calculated by the engine controller 17 on the basis of a signal from a pulse sensor 20. When the engine rotational speed exceeds a threshold value for starting fuel injection, the engine controller 17 actuates the fuel injection device of the engine 18 to increase the engine rotational speed to a target rotational speed. When the engine rotational speed becomes equal to or higher than an engine start threshold value (e.g., 600 rpm or more), the engine controller 17 determines that the engine 18 has started.

After determining that the engine 18 has started, the engine controller 17 connects the terminal connected to the coil of the starter cutting relay 16 to GND in the engine controller 17, thereby turning on (energizing) the start cutting relay 16. As a result, the start cutting relay 16 has its common terminal switched to a terminal 16*a*, preventing the electric current from flowing to the coil of the starter relay 14. The starter relay 14 is now turned off, disconnecting the starter motor 19 from the engine 18 and stopping rotation of the starter motor 19.

According to this actuation, even if the operator continuously keeps the key switch 12 in the START position, since the starter motor 19 disengages from the engine 18 and stops rotating automatically after the engine 18 has started, the starter motor 19 is not continuously rotated by the engine 18 and is prevented from suffering failures. Furthermore, even if the operator brings the key switch 12 into the START position while the engine 18 is being driven, since the starter motor 19 is not started, the starter motor 19 is not connected to the engine 18 that is rotating and is prevented from suffering failures.

Subsequently, actuation of horns 24 as a warning generating device for generating a warning to draw attention of persons present in the surroundings of the hydraulic excavator will be described below.

A horn switch 21 as a warning operation device is mounted on the tip end of a grip of a control lever disposed in the cabin 4 of the hydraulic excavator. When the operator presses the horn switch 21, contacts in the horn switch 21 are connected to each other, turning on the horn relay 13. Therefore, an electric current flows to the horns 24, which honk to draw attention of workers in the surroundings.

The hydraulic excavator includes a main controller 22 (controller) for controlling electronic devices on the machine body in its entirety.

The horn switch 21 is electrically connected to the main controller 22 through a signal line. When the horn switch 21 is pressed, the main controller 22 detects that the signal line is connected to GND. In this manner, the main controller 22 determines whether the horn switch 21 is turned on or off.

The main controller 22 includes an engine start control section 23 according to a feature of the present invention as part of its control function.

The hydraulic excavator also includes a monitor 26 for displaying, for the operator, the state of the machine body and information (coolant temperature and remaining amount of fuel) from instruments and video images from surroundings monitoring cameras. The hydraulic excavator also includes a switch box 27 as an operation device for changing contents displayed on the monitor 26, manually changing the engine rotational speed, and changing settings of an air conditioner and a radio. Furthermore, the hydraulic excavator includes a monitor controller 25 as a controller for displaying information and images on the monitor 26 and processing input signals from the switch box 27.

The engine controller 17, the main controller 22, and the monitor controller 25 are supplied with a 24V power supply, not shown, and are initialized (started up) according to a start-up process when the key switch 12 is turned into the ON position.

The controllers 17, 22, and 25 are connected to each other by way of CAN communications, and thus each of them is able to recognize the state of data input to and output from the other controllers.

Moreover, each of the controllers 17, 22, and 25 is capable of indirectly controlling relays, for example, connected to the other controllers by sending requests to actuate the relays to the other controllers. For example, the main controller 22 may send a command for turning on and off the starter cutting relay 16, and the engine controller 17 may receive the command and selectively turn on or off the starter cutting relay 16. Furthermore, the main controller 22 may generate notification information for the monitor 26, and the monitor controller 25 may receive the notification information and control the monitor 26 to display the notification information.

A system configuration for starting the engine 18 at low temperatures will then be described below.

The engine controller 17 is connected to a coolant temperature sensor 28 for measuring the temperature of a coolant in the engine 18 and an intake temperature sensor 29 for measuring the temperature of intake air of the engine 18. The engine controller 17 determines whether engine 18 is in a low temperature state or not using the temperature information from the sensors.

As long as the engine 18 is in the low temperature state and the engine 18 is cold, if fuel is injected to start the engine 18, since the heat is absorbed by the body of the engine 18 and the combustion energy is not sufficiently converted into rotational torques of the engine 18, the start-up capability of the engine 18 (the ability to get the engine 18 started) is poor.

A glow plug 30 (glow device) is inserted in the engine 18. For starting the engine 18 in the low temperature state, the engine controller 17 turns on the glow relay 15 to cause an electric current to flow through the glow plug 30 for a period of time depending on the temperature state. When an electric current flow through the glow plug 30, it generates heat to warm the combustion chamber of the engine 18 thereby to increase the start-up capability of the engine 18.

When the engine controller 17 determines that the start-up capability of the engine 18 is increased (or when the electric current has flowed through the glow plug 30 for a preset period of time that is considered to be long enough to increase the start-up capability), the engine controller 17 turns off the glow relay 15. The start-up capability of the engine 18 is increased at low temperatures by actuating the starter motor 19 to start the engine 18 while the start-up capability of the engine 18 is made high by giving a glow to (preheating) the engine 18.

State information representing the state in which a glow is being given to the engine 18 (the engine 18 is being preheated) or the state in which the start-up capability of the engine 18 is increased by preheating the engine 18 (an appropriate timing to start the engine 18) is sent by way of CAN communications from the engine controller 17 to the main controller 22 and the monitor controller 25. According to the received state information of the glow, the monitor controller 25 displays the information on the monitor 26 for the operator to recognize.

According to the present description, for the sake of convenience, the state in which a glow is being given to the engine 18 (the engine 18 is being preheated) and the start-up capability of the engine 18 has not been increased is handled as glow-ON, and the state in which the start-up capability of the engine 18 has been increased by a glow and the engine 18 may be started as determined by the engine controller 17 is handled as glow-OFF.

In the control system thus configured, the engine start control section 23 (controller) of the main controller 22 inhibits the engine 18 (prime mover) from starting when the key switch 12 (start operation device) is operated while the horn switch 21 (warning operation device) is not operated, inhibits the engine 18 from starting when the key switch 12 is operated even for the duration until a first set time T1 elapses after the operation of the horn switch 21 has been finished, permits the engine 18 to start in a case the key switch 12 is operated for the duration until a second set time T2 elapses after the first set time T1 has elapsed, and inhibits the engine 18 again from starting when the key switch 12 is operated if the engine 18 is not started for the duration until the second set time T2 elapses.

Furthermore, the engine start control section 23 (controller) of the main controller 22 determines whether the engine 18 has not been started depending on whether or not the rotational speed of the engine 18 becomes equal to or higher than a predetermined rotational speed, and permits the engine 18 to start in a case the key switch 12 has been operated at the time the second set time T2 has elapsed without the engine 18 being started.

Moreover, as described above, the hydraulic excavator further includes the monitor 26 (display device) disposed in the cabin 4, and the engine start control section 23 (controller) of the main controller 22 displays notification information representing the state in which the engine 18 is inhibited from being started and the state in which the engine 18 is permitted to be started.

Figure 3:
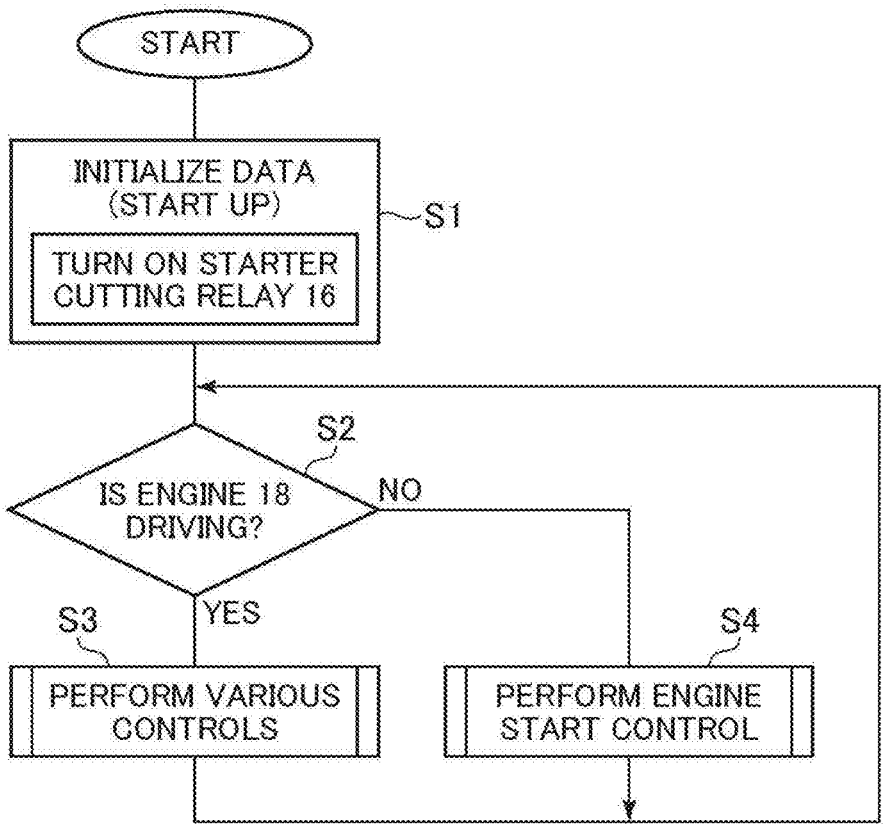
FIG. 3 is a flowchart of an overall control sequence carried out by an engine start control section of a main controller.

Details of processing contents to be executed by the engine start control section 23 of the main controller 22 will be described below with reference to FIGS. 3 and 4. FIG. 3 is a flowchart of an overall control sequence carried out by the engine start control section 23 of the main controller 22.

When the key switch 12 is turned into the ON position, starting the control system illustrated in FIG. 2, the engine start control section 23 initializes necessary data (step S1). According to the present embodiment, the engine start control section 23 turns on the starter cutting relay 16 to inhibit the engine 18 from starting as an initial state.

Then, the engine start control section 23 determines whether the engine 18 is driven or not depending on whether or not the rotational speed is equal to or higher than a start threshold value (e.g., 600 rpm or more) (step S2). If the engine start control section 23 determines that the engine 18 is driven, then it enters a subroutine for performing various controls at the time the machine body is actuated (step S3). If the engine start control section 23 determines that the engine 18 is not driven, then it enters a subroutine for performing an engine start control (step S4).

Subsequently, the processing of steps S2 through 4 is repeatedly carried out until the control system finishes its operation.

Control Sequence According to First Embodiment

Figure 4:
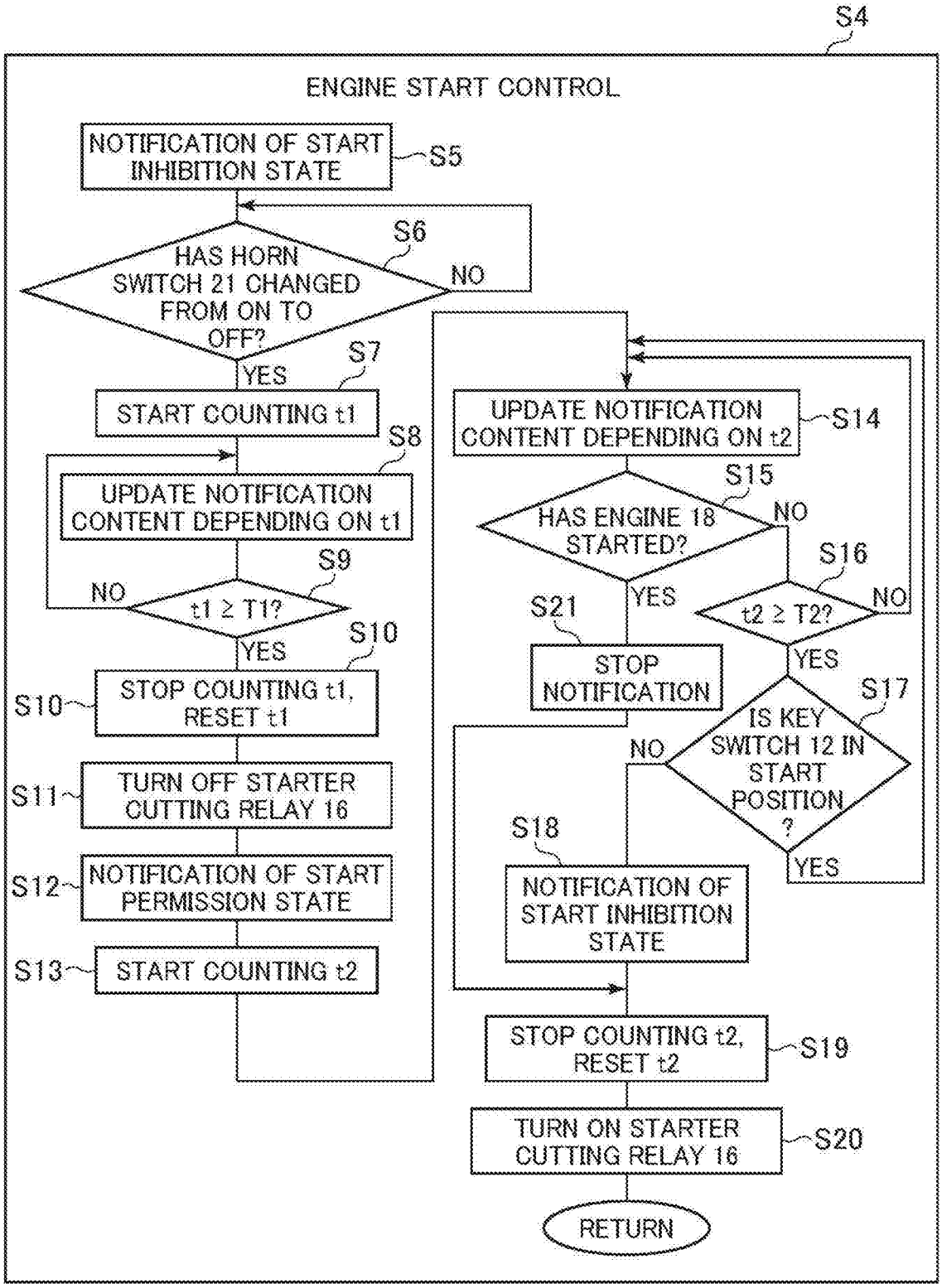
FIG. 4 is a flowchart illustrating processing contents of a subroutine for an engine start control according to a first embodiment of the present invention.

FIG. 4 is a flowchart illustrating processing contents of the subroutine for the engine start control (step S4) according to a first embodiment of the present invention.

Since the start cutting relay 16 has been turned on at the time of the initialization (step S1), when the subroutine for the engine start control (step S4) is started, the starter motor 19 cannot be actuated, and the engine 18 is in a start inhibition state.

When the subroutine for the engine start control (step S4) is started, the engine start control section 23 controls the monitor 26 to display contents indicating that the engine 18 is in the start inhibition state as a notification of the start inhibition state (step S5).

Next, the engine start control section 23 determines whether the horn switch 21 has changed from ON to OFF or not (step S6). If the horn switch 21 has not changed from ON to OFF (the horn switch 21 has not been pressed or the horn switch 21 has been pressed), then the engine start control section 23 waits while keeping the engine 18 in the start inhibition state by repeatedly executing step S6. If the horn switch 21 has changed from ON to OFF (the horn switch 21 has been released from the pressed state), then the engine start control section 23 starts counting a first count time t1 (step S7).

By using the change of the horn switch 21 from ON to OFF as a determination criterion, the engine start control section 23 can start counting the first count time t1 always after the horn 24 has finished honking. Therefore, the engine start control section 23 can start counting the first count time t1 regardless of the differences between horn honking times that may change depending on the operator and the situation in which the engine 18 is started.

When the first count time t1 starts being counted, the engine start control section 23 updates contents of a state notification to the monitor 26 (step S8), and then determines whether or not the first count time t1 becomes equal to or longer than a first set time T1 (e.g., 5 seconds) (step S9). If the first count time t1 is smaller than the first set time T1, then the processing goes back to step S8 in which the engine start control section 23 keeps the engine 18 in the start inhibition state while updating the contents of the state notification to the monitor 26. If the first count time t1 becomes equal to or longer than the first set time T1 (reaches the first set time T1), then the engine start control section 23 stops counting the first count time t1 and resets the first count time t1 (step S10).

As the contents displayed on the monitor 26 are changed depending on the first count time t1, the operator can visually confirm how much time the operator needs to wait before the engine 18 can be started, and hence the operator can calmly confirm safety in the surroundings.

Then, the engine start control section 23 turns off the starter cutting relay 16 (step S11). Since the operator can start the engine 18 at this time by turning the key switch 12 to the START position, the engine start control section 23 changes the contents of the state notification to the monitor 26 to a notification of a start permission state (step S12).

Then, the engine start control section 23 starts counting a second count time t2 (step S13), and updates the contents of the state notification to the monitor 26 depending on the second count time t2 (step S14).

As the contents displayed on the monitor 26 are changed depending on the second count time t2, the operator can visually confirm how much time will be taken before the engine 18 is inhibited from being started, and hence the operator can calmly confirm safety in the surroundings and can support a quick start of the engine 18 after having confirmed safety.

Then, the engine start control section 23 determines whether the engine 18 has started or not depending on whether or not the engine rotational speed becomes equal to or higher than an engine start threshold value (e.g., 600 rpm or more) (step S15).

If the engine 18 has not started, then the engine start control section 23 determines whether the second count time t2 becomes equal to or longer than a second set time T2 (e.g., 5 seconds) (step S16). If the second count time t2 is smaller than the second set time T2, then the processing goes back to step S14 in which the engine start control section 23 keeps the engine 18 in the start permission state (waiting for a start) while updating the contents of the state notification to the monitor 26.

If the engine 18 has started while the second count time t2 is smaller than the second set time T2 in this loop, then in order to go to the various controls (step S3) after the engine 18 has started, the engine start control section 23 stops the notification of the start permission state for the engine 18 that has been displayed on the monitor 26 (erases the displayed notification) (step S21).

Thereafter, the engine start control section 23 stops counting the second count time t2 and resets the second count time t2 (step S19), and turns on the starter cutting relay 16 (step S20), after which the processing goes back to step S2.

With the engine 18 being driven, the processing goes to the various controls (step S3), and since the starter cutting relay 16 has turned on, the function to automatically stop the starter motor 19 after the engine 18 has started and to prevent the starter motor 19 from engaging the engine 18 being driven is working.

According to another route from determining step S15, if the engine start control section 23 determines whether the engine 18 has not started in determining step S15 and if the second count time t2 becomes equal to or longer than the second set time T2 in processing step S16, then the engine start control section 23 determines whether the key switch 12 is in the START position or not (step S17).

For example, when the second set time T2 is 5 seconds and the key switch 12 has been turned into the START position when the second count time t2 has been counted up to 4.5 seconds, the starter motor 19 starts rotating, attempting to start the engine 18. In this state, even if the second count time t2 is equal to or longer than the second set time T2, it is better to keep the engine 18 in the start permission state and wait for the engine 18 to start. If step S17 were not executed, the starter motor 19 would be rotated but the engine 18 would not be started with the engine rotational speed being smaller than the engine start threshold value (e.g., smaller than 600 rpm), and the starter cutting relay 16 would be turned on, placing the engine 18 in the start inhibition state, possibly impairing the operator's natural operating capability.

If the key switch 12 is not in the START position (step S17) when the second count time t2 is equal to or longer than the second set time T2, then too much time is regarded as having elapsed from the honking of the horns 24 for drawing attention from workers in the surroundings. In order to start the engine 18 after safety has been confirmed (the horns 24 have honked), the engine start control section 23 displays a notification of the start inhibition state (a return to the initial state) on the monitor 26 (step S18), stops counting the second count time t2 and resets the second count time t2 (step S19), and turns on the starter cutting relay 16 (step S20), thereby making the starter motor 19 not be actuated to inhibit the engine 18 again from starting.

Thereafter, the processing goes back to determining whether the engine 18 is driven (step S2) illustrated in FIG. 3, thus returning to the beginning of the engine start control (step S4) and to the start inhibition state waiting for the honking of the horns 24.

Advantages of the First Embodiment

The first embodiment arranged as described above offers the following advantages:

1. Since the operator has to honk the horns 24 (warning generating device) in order to start the engine 18, a start of the engine 18 can reliably be known to the surroundings of the machine body when the engine 18 is to start, drawing attention from the surroundings of the machine body.

2. Even after the horns 24 have stopped honking, since the engine 18 cannot be started during the first set time T1, the operator is given enough time to confirm the surroundings before starting the engine 18, and can reliably confirm the surroundings of the machine body before the engine 18 is stared.

3. Even after the horns 24 have stopped honking, since the engine 18 cannot be started during the first set time T1, workers in the surroundings of the machine body are given enough time to be evacuated before the engine 18 starts.

4. As the first count time t1 is set to start being counted when the horn switch 21 has changed from ON to OFF, the first count time t1 starts to be counted always after the horn 24 has finished honking. Therefore, the engine start control section 23 can start counting the first count time t1 regardless of the differences between horn honking times that may change depending on the operator and the situation in which the engine 18 is started.

5. Even when the second count time t2 becomes equal to or longer than the second set time T2, if the key switch 12 has been turned into the START position at the time, then in order to keep the engine 18 in the start permission state, the starter motor 19 is prevented from being stopped while the operator is operating to start the engine 18, thus maintaining the operator's natural operating capability.

6. If the engine 18 has not been started for the duration until the second set time T2 has elapsed, the engine 18 is inhibited from starting when the key switch 12 is operated, and the processing goes back to the initial state after elapse of the second set time T2. Therefore, in order to start the engine 18, the operator is required to draw attention using the horns 24 again. In this respect, too, it is possible to reliably prevent the operator from starting the engine 18 without operating the horn switch 21.

Control Sequence According to Second Embodiment

Next, a second embodiment of the present invention will be described below. The configuration of a control system according to the second embodiment is the same as the configuration of the control system according to the first embodiment illustrated in FIG. 2. Inasmuch as the basics of the processing of the engine start control section 23 according to the second embodiment are identical to those according to the first embodiment illustrated in FIGS. 3 and 4, only different features will be described below.

As described above, the engine 18 has a glow plug 30 (glow device) for increasing the engine starting capability at low temperatures.

According to the second embodiment, providing the glow plug 30 (glow device) has completed its actuation, the engine start control section 23 (controller) of the main controller 22 permits the engine 18 to start in a case the key switch 12 (start operation device) is operated regardless of whether the first set time T1 has elapsed or not.

Figure 5:
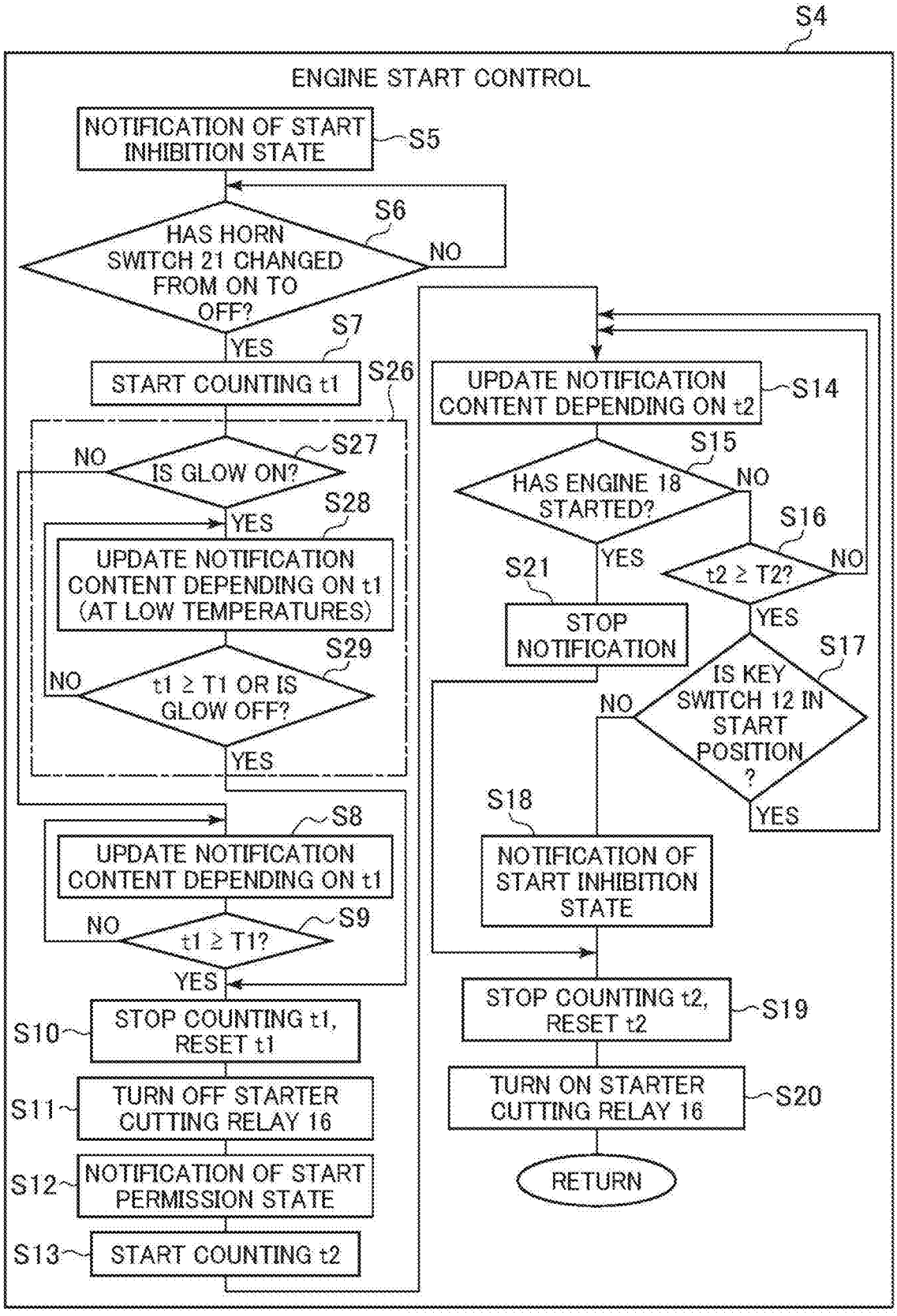
FIG. 5 is a flowchart illustrating processing contents of a subroutine for an engine start control according to a second embodiment of the present invention.

Details of processing contents to be executed by the engine start control section 23 of the main controller 22 will be described below with reference to FIG. 5. FIG. 5 is a flowchart illustrating processing contents of a subroutine (step S4) for an engine start control to be executed by the engine start control section 23 of the main controller 22 according to the second embodiment.

The overall sequence of the control to be executed by the engine start control section 23 according to the second embodiment is the same as the sequence according to the first embodiment illustrated in FIG. 3. The processing contents of the subroutine (step S4) for the engine start control illustrated in FIG. 5 are partly different from those of the subroutine according to the first embodiment illustrated in FIG. 4.

In FIG. 5, the subroutine (step S4) according to the second embodiment is different from the subroutine (step S4) according to the first embodiment illustrated in FIG. 4 in that step S26 for determining a start at low temperatures is added between step S7 and step S8 or step S10.

Specifically, after the engine start control section 23 has started counting the first count time t1 in step S7, in step S26 for determining a start at low temperatures, the engine start control section 23 determines whether the glow plug 30 is turned on or not (step S27). If the glow plug 30 is not turned on (the glow plug 30 is turned off) at the time the engine 18 is started at normal temperature, then the processing goes to step S8 in which the engine 8 is inhibited from starting during a period of time shorter than the first set time T1 (e.g., 5 seconds) after the horn switch 21 has changed from ON to OFF, as with the first embodiment.

If the glow plug 30 is turned on at the time the engine 18 is started at low temperatures, then the engine start control section 23 displays a start inhibition state at low temperatures on the monitor 26 (step S28). At this time, the start inhibition state of the engine 18 continues, and the engine start control section 23 determines whether or not the first count time t1 is equal to or longer than the first set time T1 (e.g., 5 seconds), or whether or not the glow plug 30 is turned off because the starting capability of the engine 18 has increased as the engine 18 has been preheated by the glow plug 30 (step S29). If the condition of step S29 is satisfied, then the proceeding goes to steps S10 through S12, permitting the engine 18 to be started.

Advantages of the Second Embodiment

The second embodiment arranged as described above offers the following advantages:

1. Since the glow plug 30 (for preheating the engine 18) serves the purpose of heating the combustion chamber of the engine 18 to increase the starting capability thereof, it is necessary for better operability to start the engine 18 quickly after the glow plug 30 has been turned off. According to the second embodiment, the period of time for inhibiting the engine 18 from starting (waiting for the engine 18 to start) after the horns 24 have honked due to the first set period T1 is omitted, and thus if the glow plug 30 has been turned on at low temperatures, then the engine 18 is permitted to start when the glow plug 30 changes to OFF. As the engine 18 can be started when the starting capability of the engine 18 has increased, the operability of the engine 18 is not lowered. According to the second embodiment, therefore, it is possible to achieve both operability and safety in certain situations.

According to the second embodiment, moreover, after elapse of the first set time T1 from the honking of the horns 24, the engine 18 can be started as with the first embodiment without waiting for the glow plug 30 to be turned off.

2. According to the second embodiment, it is also necessary to honk the horns 24 in order to start the engine 18. Therefore, when the engine 18 is to start, a start of the engine 18 can reliably be known to the surroundings of the machine body, drawing attention from the surroundings of the machine body. Furthermore, even after the horns 24 have stopped honking, since the engine 18 cannot be started during the first set time T1, the operator is given enough time to confirm the surroundings before starting the engine 18, and can reliably confirm the surroundings of the machine body before the engine 18 is started. In addition, workers in the surroundings of the machine body are given enough time to be evacuated before the engine 18 starts.

3. Even when the engine 18 is permitted to start after the glow plug 30 has been turned off, since the limitation of the time for permitting the engine 18 to start due to the second set time T2 is effective, if the time during which the engine 18 has not started has elapsed for the second set time T2 after the glow plug 30 has been turned off, it is necessary to draw attention by honking the horns 24 for starting the engine 18. In this respect, too, it is possible to reliably prevent the engine 18 from starting without operating the horn switch 21.

Although not illustrated in the flowchart of FIG. 5, it may be necessary to take into account conditions for turning on the glow plug 30 for achieving both operability and safety.

First, it is necessary to perform a process for preventing the glow plug 30 from being turned on unless the temperature is low or for not regarding the glow plug 30 as being turned on according to a control approach. If there is an engine 18 in which the glow plug 30 is turned on for a short period of time at all times when the key switch 12 is turned on, not directly related to the purpose of preheating the engine 18, then if the glow plug 30 is turned on when the horns 24 are honked, it is possible to start the engine 18 immediately thereafter. Such an actuation is not intended by the present invention.

Furthermore, the time during which the glow plug 30 is turned on at low temperatures (or the time during which the glow plug 30 is regarded as being turned on at low temperatures) should be set to a value longer than the first set time T1. With such a time setting, it is easier to keep an enough time to confirm safety until the engine 18 is permitted to start after the horns 24 have been honked even at low temperatures that require the glow plug 30 to be turned on.

(Monitor Screen Layout)

Figure 6:
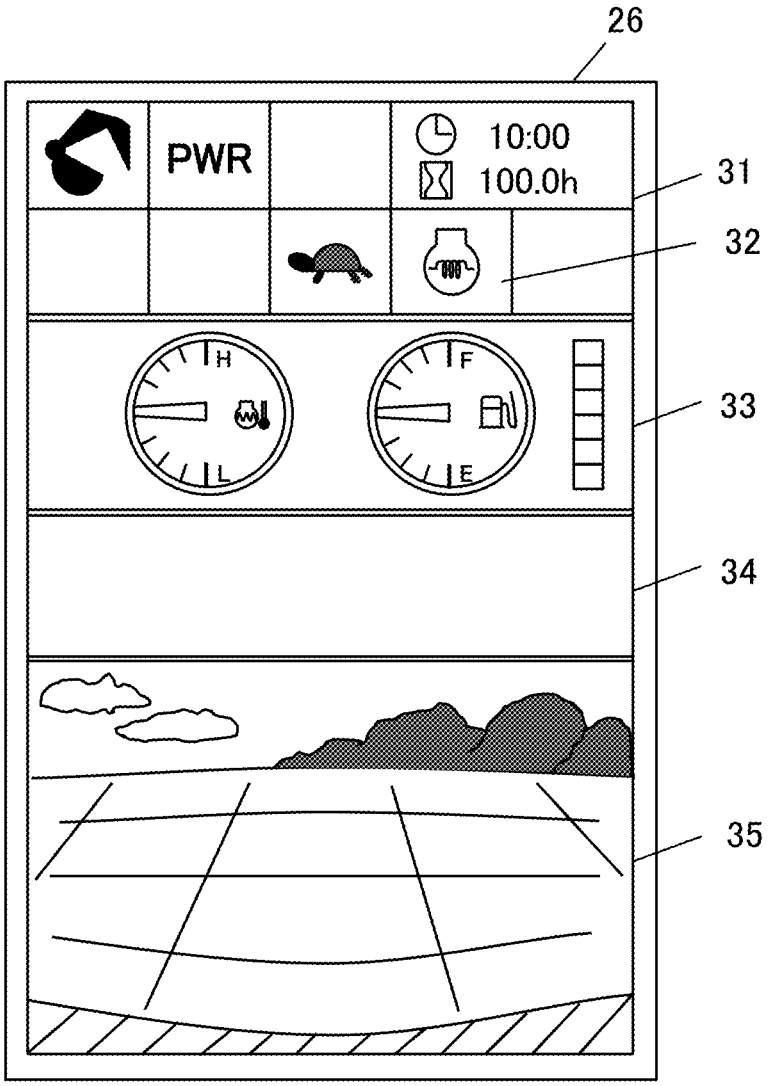
FIG. 6 is a view illustrating a monitor according to the first and second embodiments of the present invention.

FIG. 6 is a view illustrating the monitor 26 according to the first and second embodiments of the present invention.

The monitor 26 includes a display screen divided mainly into four areas including a state display area 31, an instrument display area 33, a notification information display area 34, and a surroundings monitoring camera image display area 35.

In FIG. 6, the state display area 31, which is located in an uppermost position, displays state information such as a clock time or an hour meter, a current work mode, a current power mode, a current travelling mode (high speed or low speed), and the like. A glow actuation display sign 32 for displaying a state of the glow plug 30 is also displayed in the state display area 31. When the glow plug 30 is turned on, the glow actuation display sign 32 is displayed. When the glow plug 30 is turned off, the glow actuation display sign 32 is not displayed.

The instrument display area 33 is disposed beneath the state display area 31, and displays a coolant temperature, a remaining-amount-of-fuel meter, a mileage meter, and the like.

The notification information display area 34 is disposed beneath the instrument display area 33, and displays a notification of the start inhibition state (step S5 and step S18) according to the first and second embodiments of the present invention, updating of the notification contents depending on the first count time t1 (step S8), a notification of the start permission state (step S12), and updating of the notification contents depending on the second count time t2 (step S14).

Notification information according to a notification of the start inhibition state at low temperatures (step S24) according to the second embodiment is also displayed in the notification information display area 34.

The surroundings monitoring camera image display area 35 is disposed beneath the notification information display area 34, and displays a video image for monitoring regions behind of the hydraulic excavator, on the lefts and right sides of the hydraulic excavator, and in all the surroundings of the hydraulic excavator.

(Contents of Notifications to the Monitor 26 According to the First and Second Embodiments)

Figure 7:
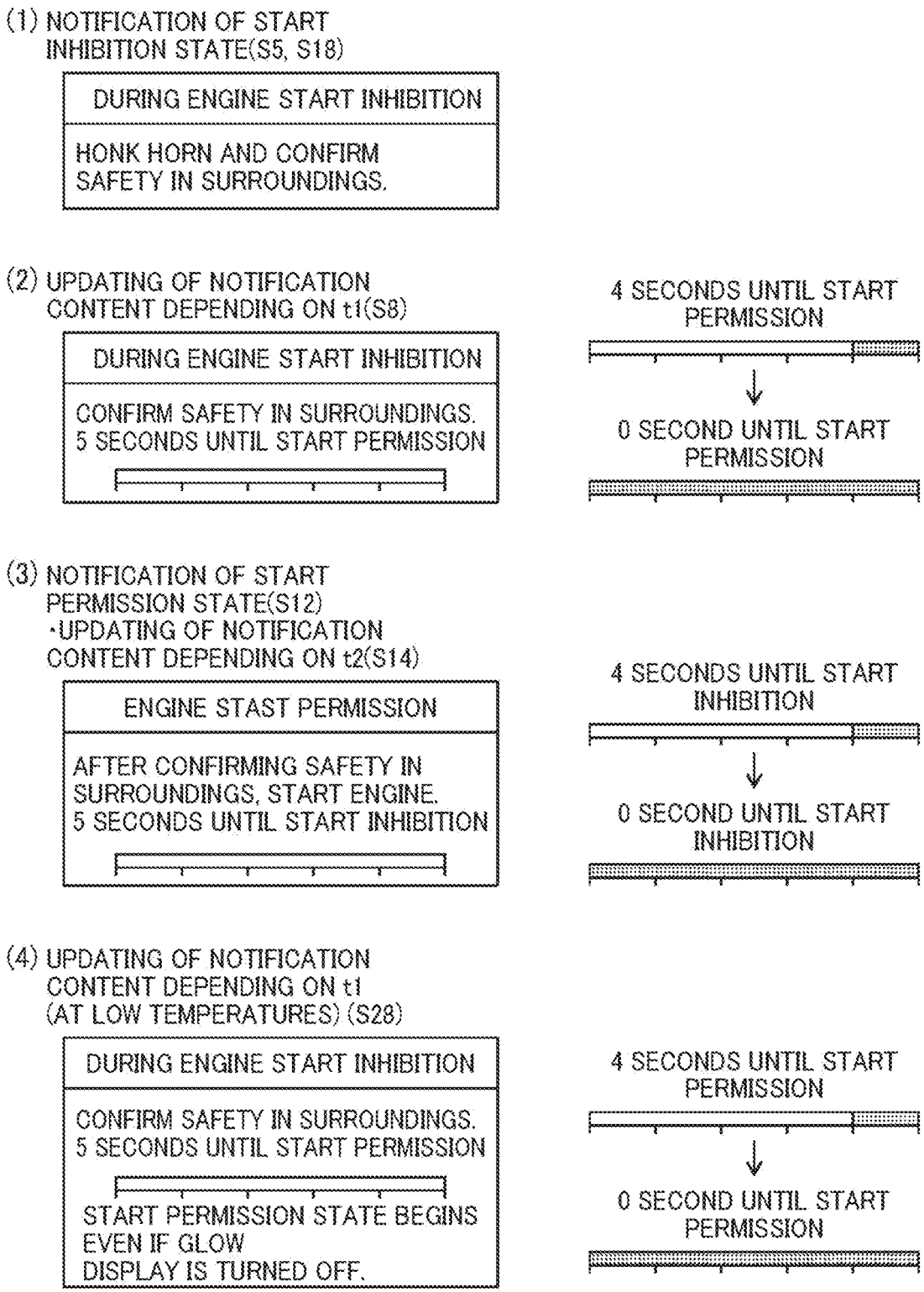
FIG. 7 is a diagram illustrating notified contents displayed in a notified information display area of the monitor according to the first and second embodiments of the present invention.

FIG. 7 is a diagram illustrating notified contents displayed in the notification information display area 34 of the monitor 26 according to the first and second embodiments of the present invention.

FIG. 7 illustrates in (1) notified contents that are displayed in the notification information display area 34 in steps S5 and S18. A message "DURING ENGINE START INHIBITION" representing a current state is displayed in an upper area, and a message "HONK HORN AND CONFIRM SAFETY IN SURROUNDINGS" representing an action that the operator is instructed to do is displayed in a lower area.

These displayed messages allow the operator to recognize at a glance the current state of the machine body and what to do. Therefore, the operator is not required to see the display on the screen of the monitor 26 for a long time and to operate the switch box 27 to confirm the notified contents, and can take time to confirm safety in the surroundings.

FIG. 7 illustrates in (2) notified contents of the start inhibition state depending on the first count time t1 that are displayed in step S8. A message "DURING ENGINE START INHIBITION" representing a current state is displayed in an upper area, and a message "CONFIRM SAFETY IN SURROUNDINGS," "5 SECONDS UNTIL START PERMISSION" representing an action that the operator is instructed to do is displayed in a lower area. A bar representing the elapse of time is displayed beneath the message in the lower area.

When the first set time T1 is preset to 5 seconds, if the first count time t1 is 0 second, the message "5 SECONDS UNTIL START PERMISSION" representing T1 is displayed in the lower area, together with a bar displayed to the right end. The displayed message in the lower area changes successively from "4 SECONDS UNTIL START PERMISSION," to "3 SECONDS UNTIL START PERMISSION," to "2 SECONDS UNTIL START PERMISSION," to "1 SECONDS UNTIL START PERMISSION," and finally to "0 SECOND UNTIL START PERMISSION" representing T1−t1 (the difference calculated by subtracting t1 from T1) as the first count time t1 elapses.

The displayed bar includes an outlined portion that gradually decreases to represent T1−t1 until finally it is not displayed at all.

The displayed bar makes it possible for the operator to recognize at a glance how many seconds are left before the engine 18 can be started after honking the horns 24, and thus the operator can calmly confirm safety in the surroundings.

FIG. 7 illustrates in (3) notified contents of the start permission state depending on the second count time t2 that are displayed in step S12 and step S14. A message "DURING ENGINE START PERMISSION" representing a current state is displayed in an upper area, and a message "AFTER CONFIRMING SAFETY IN SURROUNDINGS, START ENGINE," "5 SECONDS UNTIL START INHIBITION" representing an action that the operator is instructed to do is displayed in a lower area. A bar representing the elapse of time is displayed beneath the message in the lower area.

When the second set time T2 is preset to 5 seconds, if the second count time t2 is 0 second, the message "5 SECONDS UNTIL START INHIBITION" representing T2 is displayed in the lower area, together with the bar displayed to the right end. The displayed message in the lower area changes successively from "4 SECONDS UNTIL START INHIBITION," to "3 SECONDS UNTIL START INHIBITION," to "2 SECONDS UNTIL START INHIBITION," to "1 SECONDS UNTIL START INHIBITION," and finally to "0 SECOND UNTIL START INHIBITION" representing T2−t2 (the difference calculated by subtracting t2 from T2) as the second count time t2 elapses.

The displayed bar includes an outlined portion that gradually decreases to represent T2−t2 until finally it is not displayed at all.

The displayed bar makes it possible for the operator to recognize at a glance how many seconds are left before the engine 18 is inhibited from starting after the engine 18 has been in the start permission state, and thus the operator can calmly confirm safety in the surroundings and can support a quick start of the engine 18 after having confirmed safety.

FIG. 7 illustrates in (4) notified contents of the start inhibition state at low temperatures. A message "DURING ENGINE START INHIBITION" representing a current state is displayed in an upper area, and a message "CONFIRM SAFETY IN SURROUNDINGS" together with a countdown message and a bar representing the elapse of time, which are the same as those in FIG. 7 in (2), is displayed in a middle area.

Furthermore, a message representing "START PERMISSION STATE BEGINS EVEN IF GLOW ACTUATION DISPLAY IS TURNED OFF" is displayed in a lower area.

The displayed messages make it possible for the operator to recognize not only the start inhibition state, but also that the start inhibition state is unique to the actuation of the glow plug at low temperatures and that the engine 18 can be started when the glow actuation display sign is turned off.

(Others)

Since it is the object of the present invention to reliably prompt workers in the surroundings to pay attention before the engine 18 starts and also to inhibit the engine 18 from starting immediately after a warning is generated, the above embodiments may be revised and modified insofar as the same object can be achieved.

For example, while the horns 24 are used as a warning generating device in the above embodiments, a warning generating device for generating warning light from a rotary lamp or the like may be used. The latter warning generating device is considered to be more effective than the horns 24 when used at sites where ambient noise is large or sites where workers wear earplugs.

According to the above embodiments, it is determined whether the horns 24 are turned on or off on the basis of the signal from the horn switch 21. In this case, however, in the event of a failure of the horns 24, the engine start control section 23 of the main controller 22 determines that the horn switch 21 is turned on though the horns 24 are not honked. In view of such a drawback, a microphone, for example, may be installed in the vicinity of the horns 24, and the engine start control section 23 may determine whether the horn switch 21 is turned on or off on the basis of an input level from the microphone.

According to the present invention, the construction machine with the engine 18 mounted thereon has been described. However, the task of letting the starting of a prime mover be known to the surroundings of the machine body should not limit the kind of the prime mover. The present invention is also applicable to electric hydraulic excavators that incorporate an electric motor as a prime mover, for example. In such a case, means for inhibiting the prime mover from starting may be optimally selected to match the object to which the present invention is applied.

DESCRIPTION OF REFERENCE CHARACTERS

1: Lower track structure
2: Upper swing structure
3: Front work implement
4: Cabin
11: Battery
12: Key switch (key cylinder) (start operation device)
13: Horn relay
14: Starter relay
15: Glow relay
16: Starter cutting relay

17: Engine controller (ECU)
18: Engine (prime mover)
19: Starter motor
20: Pulse sensor
21: Horn switch (warning operation device)
22: Main controller (MC) (controller)
23: Engine start control section (controller)
24: Horn (warning generating device)
25: Monitor controller
26: Monitor (display device)
27: Switch box
28: Coolant temperature sensor
29: Intake temperature sensor
30: Glow plug (glow device)
31: State display area
32: Glow actuation display sign
33: Instrument display area
34: Notification information display area
35: Surroundings monitoring camera image display area

The invention claimed is:

1. A construction machine comprising:

a prime mover;

a hydraulic drive system including a hydraulic pump driven by the prime mover;

a prime mover starting device including a start operation device for starting the prime mover;

a warning generating device;

a warning operation device for actuating the warning generating device; and a controller, wherein the controller is configured to inhibit the prime mover from starting when the start operation device is operated while the warning operation device is not being operated, inhibit the prime mover from starting when the start operation device is operated even for duration until a first set time elapses after the warning operation device finishes being operated, permit the prime mover to start in a case the start operation device is operated for duration until a second set time elapses after the first set time has elapsed, and inhibit the prime mover from starting when the prime mover has not been started for the duration until the second set time elapses.

2. The construction machine according to claim 1, wherein the controller is configured to determine whether or not the prime mover has not been started for the duration until the second set time elapses by determining whether or not rotational speed of the prime mover becomes equal to or higher than a predetermined rotational speed, and permit the prime mover to start in a case the start operation device is operated when the second set time has elapsed without the prime mover being started.

3. The construction machine according to claim 1, wherein the prime mover comprises an engine, the engine has a glow device for increasing starting capability of the engine at low temperatures, and the controller is configured to permit the prime mover to start in a case the start operation device is operated regardless of whether the first set time has elapsed or not if the glow device has completed actuation.

4. The construction machine according to claim 1, further comprising:

a display device disposed in a cabin, wherein the controller controls the display device to display notification information representing a state in which the prime mover is inhibited from starting and a state in which the prime mover is permitted to start.

* * * * *